United States Patent [19]

Crompton

[11] Patent Number: 5,067,727

[45] Date of Patent: Nov. 26, 1991

[54] RING TOSS GAME

[76] Inventor: Perry D. Crompton, 15543 Sprig St., Chino Hills, Calif. 91709

[21] Appl. No.: 697,029

[22] Filed: May 7, 1991

[51] Int. Cl.[5] ..... A63B 67/06

[52] U.S. Cl. ..... 273/336; 273/346; 273/415; 273/425; 273/DIG. 30

[58] Field of Search ..... 273/336, 337, 338, 339, 273/346, 415, 424, 425, DIG. 30

[56] References Cited

U.S. PATENT DOCUMENTS

| | | | |
|---|---|---|---|
| 1,513,968 | 11/1924 | Crandall | 273/336 |
| 1,593,453 | 7/1926 | Hinsen | 273/415 |
| 1,899,820 | 2/1933 | Milne | 273/336 |
| 2,776,140 | 1/1957 | Carlson | 273/338 |
| 3,480,280 | 11/1969 | Gamertsfelder | 273/415 |
| 3,802,704 | 4/1974 | Genua | 273/336 |
| 4,017,076 | 4/1977 | Bai | 273/346 |
| 4,049,271 | 9/1977 | Fouti | 273/346 |
| 4,447,060 | 5/1984 | Guinn | 273/346 |
| 4,653,582 | 3/1987 | Ehrenfried | 273/346 X |
| 4,736,955 | 4/1988 | Pollock | 273/346 X |
| 4,952,073 | 8/1990 | Wieland | 273/336 X |
| 4,971,334 | 11/1990 | Stewart | 273/346 |
| 4,989,880 | 2/1991 | Gettemeier | 273/336 |

*Primary Examiner*—William H. Grieb

*Attorney, Agent, or Firm*—William L. Chapin

[57] ABSTRACT

A game of skill playable both indoors and outdoors includes two flat circular target boards, the upper surface of which are covered with a deep pile fabric. The game also includes toroidal-shaped throwing rings having a flexible cover and filled loosely with a quantity of small weights such as pebbles. Strips of fabric hook material having an abundance of tiny protruding hooks adapted to engage the pile of the target board covering material are attached to the upper and lower annular surfaces of each throwing ring. When a ring is cast upon a distant target board, the hooks protruding from the ring become entangled with strands of the fabric covering of the target board, adhering the ring to the board. Movement of the weights within the throwing ring produces an oscillation-damping action which minimizes any tendency of the ring to bounce off the target board after impact.

22 Claims, 2 Drawing Sheets

RING TOSS GAME

BACKGROUND OF THE INVENTION

A. Field of the Invention

The present invention relates to games of skill. More particularly, the invention relates to a throwing game in which ring-shaped throwing objects are tossed at a target lying on the floor or ground.

B. Description of Background Art

Throwing games have been a popular recreational activity from time immemorial. Hurling an object at a target requires hand-eye coordination and concentration which can help the player forget for awhile the mundane cares of the world. Partaking in games of skill that involve throwing objects at a distant target also can help development of hand-eye coordination and muscle tone.

The game of horseshoes typifies games of skill in which objects are thrown at a distant target. In that game, opponents throw horseshoes at a metal stake driven into the ground about 40 feet apart from another stake. Points are scored by encircling a distant stake with a thrown horseshoe, or landing a thrown horseshoe within a pre-determined distance from the stake.

The ancient game of horseshoes remains popular today, even among certain illustrious players such as U.S. Presidents. That popularity has inspired a number of inventions related to the game. For example, Wieland, U.S. Pat. No. 4,952,073, Aug. 28, 1990. Mats Convertible Into a Bag, discloses a pair of mats to protect a lawn during a horseshoe game. The mats are convertible into a bag for carrying horseshoe equipment and other items.

A variety of throwing games have been disclosed which use throwing objects that are substantially lighter than horseshoes, and therefore more suitable for use by small children as well as adults. Thus, Milne, U.S. Pat. No. 1,898,920, Feb. 28, 1933, Game, discloses a throwing game having a circular, corrugated rubber target mat and rubber throwing rings shaped like tires. Genua, U.S. Pat. No. 3,802,704, Apr. 9, 1974, Combination Bolster Pillow and Rinc Toss Apparatus, discloses a bolster type pillow for conversion to a ring toss game. The game consists of a pillow core element, a pair of ring toss pins, and a contoured and fitted protective cover for the pillow core element.

The following U.S. Pats. disclose throwing games which employ complementary hook-and-eye fabric materials on a throwing object and a target:

Bai, 4,017,076, Apr. 12, 1977, Target Game;

Fonti, 4,049,271, Sept. 20, 1977, Target Board Sail Game;

Guinn, 4,447,060, May 8, 1984, Target Game;

Pollock 4,736,955, Apr. 12, 1988, Pitch and Toss Game; and

Stewart, 4,971,334, Nov. 20, 1990, Throw and Catch Game.

The present invention was conceived of to provide a ring toss game having improved playing characteristics, ease of storage and transportation.

OBJECTS OF THE INVENTION

An object of the present invention is to provide an improved ring throwing game that employs complementary hook and eye fabrics on a throwing ring and on a target.

Another object of the invention is to provide a ring toss game in which the tendency of a ring to bounce away from its initial impact point on a target board is minimized.

Another object of the invention is to provide a ring toss game in which the throwing rings have improved flight characteristics.

Another object of the invention is to provide a ring toss game in which the throwing rings are of a novel design which permits effective interaction of hook-type fastener material on the throwing ring with a deep pile or loop-type fabric on a target board, while employing a minimum amount of hook-type material, thereby minimizing the cost of the throwing rings.

Another object of the invention is to provide a ring toss game in which target boards comprising part of the game are adapted to enclose and hold other components of the game, to facilitate storage and transportation of the game.

Another object of the present invention is to provide a ring toss game in which the target boards are adapted to conveniently sandwich therebetween all other components of the game, without the requirement for any auxiliary fastening means.

Various other objects and advantages of the present invention, and its most novel features, will become apparent to those skilled in the art by perusing the accompanying specifications, drawings and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a game of skill, playable outdoors or indoors, in which players toss throwing objects at a target board placed on the ground or floor. The ring toss game according to the present invention includes two flat target boards which are adapted to be placed on the ground or floor, a measured distance apart from one another. The upper surface of each target board is covered with a sheet of loose pile fabric having an abundance of strands of looped or free fibers which protrude outwards from the fabric.

The ring toss game according to the present invention includes throwing rings of novel design. Each throwing ring is made of a flexible fabric material shaped generally like a doughnut, i.e., having a toroidal shape, and filled loosely with a quantity of small weights, such as pebbles. Strips of VELCRO(TM)-type material covered with a two-dimensional array of tiny hooks "complementary" to the pile of the target board material are attached to the upper and lower annular surfaces of each throwing ring. Complementary here means that the hooks are of the proper size and shape to readily become adherently entangled with strands of the pile material. When a throwing ring impacts a target board, entanglement between the complementary hook and loop materials on the throwing ring and target board, respectively, causes the ring to adhere to the board without bouncing.

The presence of hook strips on both sides of the throwing rings allows the rings to be sandwiched between the pile surfaces of the two target boards, thereby adhering all of the components of the game together in a novel self-contained package which may be conveniently transported and stored. The preferred embodiment includes a stake insertable through a central coaxial hole provided in each game board, the stake serving as a target, and as means for holding the game board in place when the stake is driven into the ground.

DETAILED DESCRIPTION OF THE INVENTION

Referring now to FIGS. 1 through 8, a novel ring toss game according to the present invention is shown.

Figure 1:
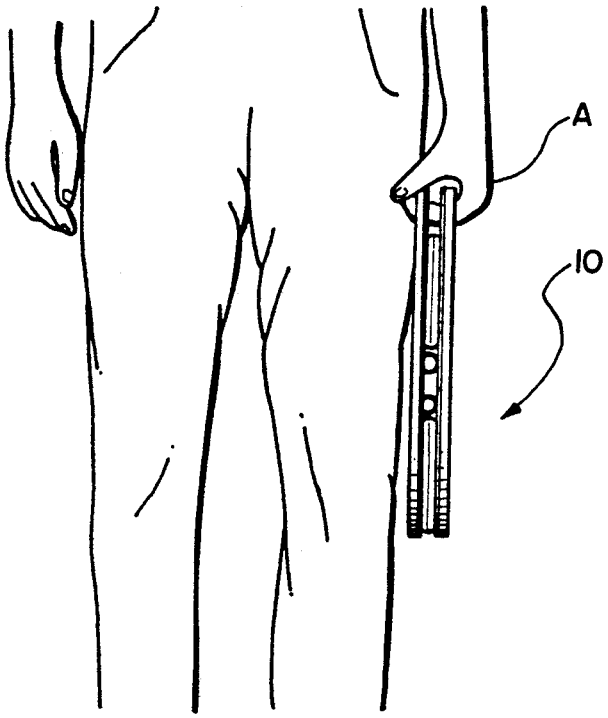
FIG. 1 is an end elevation view of a ring throwing game according to the present invention, showing the game being carried in a closed configuration suitable for storing and transporting the game.
Figure 2:
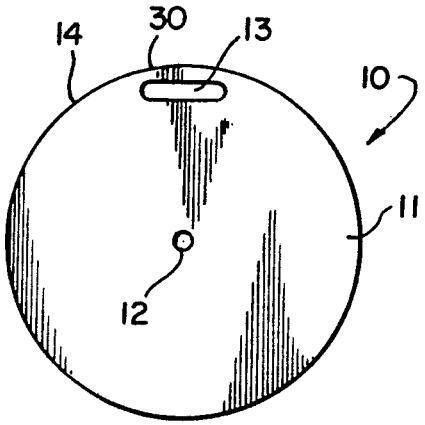
FIG. 2 is a front elevation view of the game of FIG. 1, in the same configuration as shown in FIG. 1.

FIGS. 1 and 2 show a ring toss game 10 according to the present invention in a closed configuration suitable for storing and transporting the game. As shown in FIGS. 1 and 2, game 10 includes two identically shaped target boards 11. Target boards 11 are made of flat sheets, preferably of rigid material such as wood, plastic, pressboard or the like. In the preferred embodiment, each target board 11 has a central coaxial hole 12 and is generally circularly shaped. Preferably, as shown in FIG. 1, each target board 11 also has a rectangular hole 13 of a suitable size and shape to be engaged by a human hand A, for carrying game 10. Carrying hole 13 is located near the circumferential perimeter or rim 14 of board 11.

Figure 3:
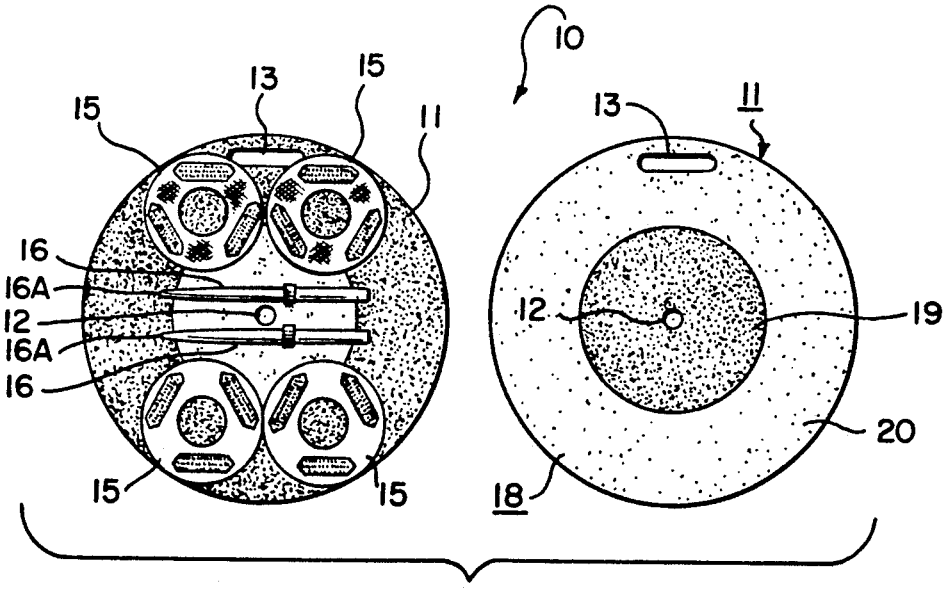
FIG. 3 is an upper plan view of the game of FIGS. 1 and 2, showing the game in an open configuration preparatory to playing the game.

FIG. 3 shows game 10 in an open configuration preparatory to deploying the target boards 11 into spaced-apart playing positions As shown in FIG. 3, components of game 10 in addition to target boards 11 include a plurality of throwing rings 15. Game 10 may also be provided with a pair of stakes 16 adapted to be inserted into coaxial holes 12 in target boards 11.

Figure 4:
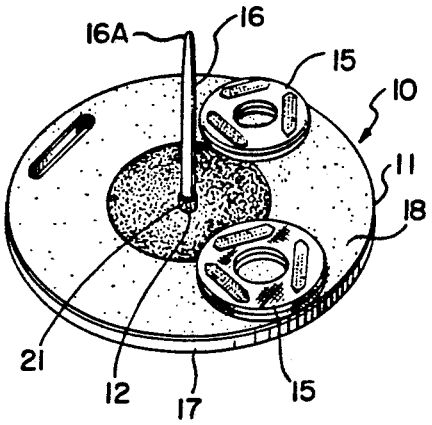
FIG. 4 is an upper plan view of a target disk comprising part of the game of FIG. 1 in a playing position.

Referring to FIGS. 2, 3 and 4, target board 11 is shown to have a base 17 covered with a sheet 18 of fabric. Fabric sheet 18 is made of a material such as "indoor/outdoor" carpeting made of nylon and having an abundance of fibers which protrude upwards from the sheet to form a loose pile of both free and intertwined strands. Fabric sheet 18 may be fastened to the upper surface of base 17 by any convenient means, such as adhesive bonding, for example. Preferably, the upper surface of fabric sheet 18 has thereon at least two different colored, inner and outer concentric target zones 19 and 20. Scoring indicia (not shown) may also be imprinted on the target zones, if desired.

FIG. 4 shows a target board 11 in a playing position on a floor or other hard surface In FIG. 4, an optional stake 16 is inserted through central coaxial hole 12 of target board 11 into the ground. Thus positioned, stake 16 provides a target to be encircled by a tossed ring 15. When used on a soil surface, stake 16 is reversed, the sharper upper end 16A being driven into the ground, to secure target board 11 in place.

As may be seen best by referring to FIGS. 3 and 4, stake 16 has an elongated cylindrical shape, the upper half 16A of which tapers to a slightly smaller diameter, rounded end. An encircling band 21 of VELCRO(TM)-hook fabric is fastened around the circumference of each stake 16, near the base of the stake. The hook material of which fabric band 21 is made of is of the proper texture to adhesively engage the complimentarily textured pile on the fabric sheet 18 covering target board 11. Thus, when a stake 16 is laid down parallel to cover sheet 18 on board 11 and pressed into the pile surface of the cover sheet, the hooks on fabric band 21 engage the fibers of the cover sheet, thereby adhering the stake and board to one another to facilitate storage and transportation of the game.

FIGS. 5 through 8 illustrate in more detail the novel structure of throwing rings 15.

As shown in FIGS. 5 through 8, each throwing ring 15 has a generally toroidal shape. Although ring 15 may have any desired size, a suitable approximate size would be 5 ½ inch outer diameter by, 2 ¼ inch inner diameter. Ring 15 has a cover 22 which is made from a flexible fabric such as heavy gauge woven nylon having a thickness in the approximate range of 0.10 inch to 0.015 inch. Preferably, cover 22 of ring 15 is made of an upper annular strip 23 and a lower annular strip 24 which are sewn together on an inner circumferential seam 25 and an outer circumferential seam 26.

Figure 5:
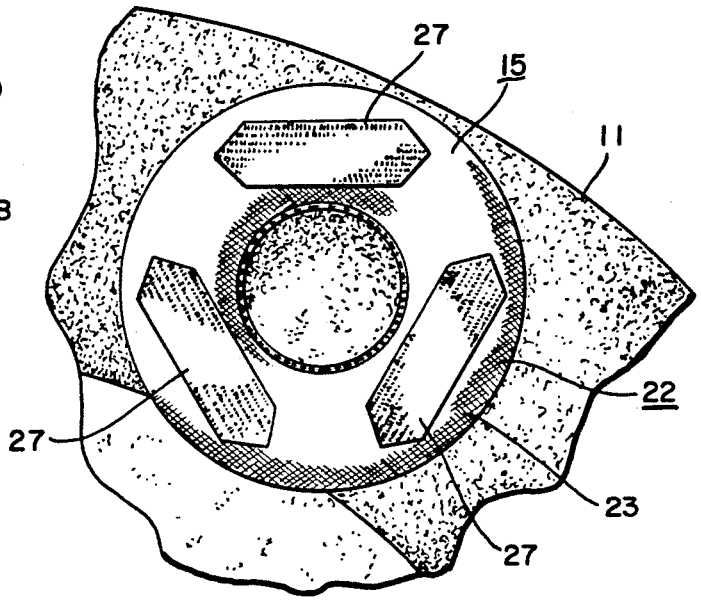
FIG. 5 is an upper plan view of a throwing ring comprising a component of the game of FIG. 1, on a somewhat enlarged scale.
Figure 6:
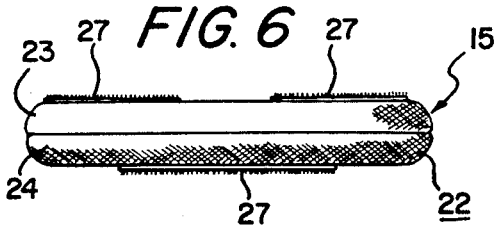
FIG. 6 is an end elevation view of the throwing ring of FIG. 5.
Figure 7:
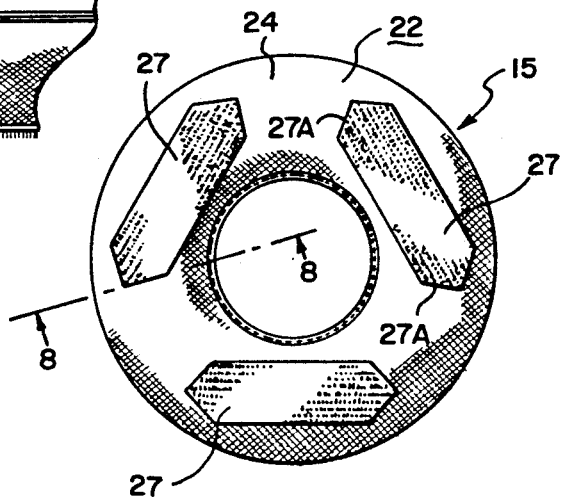
FIG. 7 is a lower plan view of the throwing ring of FIG. 5.

As may be seen best by referring to FIGS. 5 through 7, a plurality of elongated rectangular strips 27 of nylon VELCRO(TM)-type hook material are fastened to both the upper annular cover strip 23 and lower annular cover strip 24 of ring 15. In the preferred embodiment, each of the strips 27 on a cover strip are parallel to a chord of ring 15, and are circumferentially spaced apart from one another.

Preferably, as shown in FIG. 6, each strip 27 on one side of ring 15 is positioned with its radial center line aligned with the radial center line defining the midpoint of the circumferential gap between two adjacent strips on the other side of the strip. This configuration of hook strips 27 has been found by the present inventor to provide a desirable ring when being held and when in flight, while allowing the ring, on impact, without bouncing off of the target board.

As shown in FIGS. 5 through 7, a desirable configuration for strips 27 on ring 15 is a group of three strips, spaced apart at 120-degree circumferential intervals on both upper and lower sides 23 and 24 of the ring, with each strip on one side symmetrically straddling a circumferential gap between adjacent strips on the other side, as described above. As depicted in the figures, a suitable angular width of each strip 27 is about 70 degrees, giving a spacing of about 50 degrees between the ends of each pair of adjacent strips. Preferably, each opposite lateral edge 27A of each strip 27 is cut obliquely, so as to lie approximately on a radius of ring 15.

Figure 8:
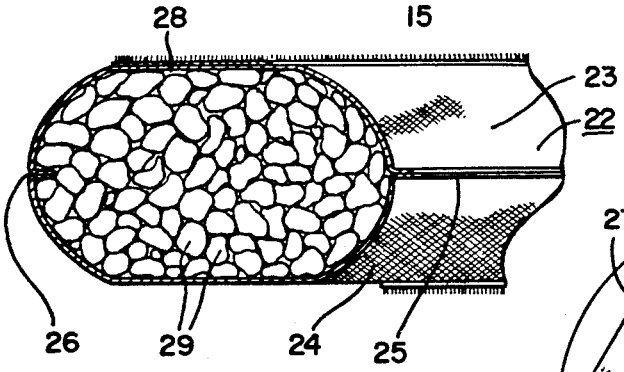
FIG. 8 is a sectional elevation view of the throwing ring of FIG. 7, taken along line 8—8 of FIG. 7.

The internal structure of rings 15 may be best understood by referring to FIG. 8. As shown in FIG. 8, the inner generally toroidal shaped space 28 between upper annular cover 23 and lower annular cover 24 of ring 15 is filled loosely with a quantity of small objects 29. Lead shot or other small spherical pellets of generally uniform size may provide a suitable choice for filling objects 29. However, the present inventor has found that small pebbles or pea gravel in the approximate size range of one-quarter inch to one-half inch in diameter provides a highly desirable filling material for ring 15.

As shown in FIG. 8, inner toroidal space 28 of ring 15 is only partially filled with filling objects 29. Although the precise percentage of filling is not critical, the present inventor has found that a suitable percentage is 75 percent, with a tolerance of about plus or minus 20 percent.

The reason for only partially filling space 28 of ring 15 with filling objects 29 is two-fold. First, as shown in FIG. 8, filling space 28 only partially causes the transverse cross-sectional shape of ring 15 to be oval rather than circular That oval cross-section makes upper annular cover strip 23 and lower annular cover strip 24 to be more generally flat and parallel. Thus, when ring 15 is thrown at target board 11, a larger surface area of hook strips 27 is presented to cover sheet 18 of the target board. This greater contact area provides more reliable adherence between a tossed ring 15 and target board 11, minimizing the likelihood that a ring will bounce away from its initial impact point on the target board.

A second reason for filling ring 15 only partially with filling objects 29 is to afford greater flexibility to the ring. This flexibility, coupled with the damping action provided by frictional contact between filling objects permitted to move within ring 15, absorbs impact shock and minimizes the tendency of a ring to bounce elastically off of a surface upon which it impacts.

The novel construction of rings 15 makes the rings sufficiently rigid to retain their generally toroidal shape while being held and in flight, but sufficiently flexible to adhere readily to the target board material, and to remain at an impact point without bouncing, regardless of which portion of the ring impacts the target board. It is important to note that novel construction of the rings 15 according to the present invention affords the aforementioned performance advantages over prior art ring throwing games, while employing a minimum amount of nylon hook material. Since that material is quite expensive, minimization of the amount of material required by the novel design of the present invention is highly desirable.

As may be seen best by referring back to FIGS. 1 through 3, the novel design of ring toss game 10 permits all of the components of the game to be adhered to one another to form a novel self-contained package. Thus, as shown in FIG. 3, stakes 16 and throwing rings 15 may be placed down on fabric cover sheet 18 of one of the two target boards 11 after completion of play of game 10. Engagement of the loose pile of cover sheet 18 by bands 21 of hook material on stakes 16 adheres the stakes to the surface of the target board 11. Similarly, engagement of the surface of cover sheet 18 by strips 27 of hook material on the lower surfaces 24 of each throwing ring 15 adheres each throwing ring to a target board.

With stakes 16 and rings 15 thus adhered to one of the two target boards 11, the second target board 11 is inverted and placed, face down, in contact with the upper surfaces of stakes 16 and throwing rings 15, thereby adhering fabric cover sheet 18 of the second target board to bands 21 of the stakes, and to hook strips 27 on the upper surface of each ring 15. In placing the second target board 11 down upon the first target board and attached rings 15 and stakes 16, the two target boards are coaxially aligned, and also azimuthally aligned, thus aligning rectangular carrying holes 13 of the two target boards. Target boards 11, positioned with respect to one another as described above, form the outer halves of a self-contained as shown in FIGS. 1 and 2. The closed configuration of game 10 shown in FIGS. 1 and 2 is of a compact size which makes the game easy to store and transport. As may be seen best by referring to FIG. 2, carrying hole 13 is so positioned relative to rim 14 of target board 11 as to form an elongated, curved rib 30 between the outer circumferential edge of the hole and the rim. Thus, as shown in FIGS. 1 and 2, game 10 may be comfortably carried by inserting a hand through carrying holes 13 of target boards 11 of the game, and grasping the ribs 30 radially outward of the carrying holes.

What is claimed is:

1. A game of skill comprising;

a. a first target board having on a surface thereof a fabric covering with a loose pile, b. a second target board substantially identical to said first game board, and c. at least one throwing object for tossing from a distance onto either of said first and second target boards, said throwing object having on two opposite sides thereof fabric having a plurality of hooks protruding therefrom of the proper size and shape to adhere to said loose pile of said target board, whereby said throwing object will adhere to said target board when thrown onto said target board, and whereby said first and second target boards may be adhered to opposite sides of said throwing object, thereby forming a self-contained package sandwiching said throwing object between said first and second target boards.

2. The game of claim 1 wherein said throwing object is further defined as having a pair of generally parallel surfaces, one each of said pair of surfaces on an opposite side of said object, each of said surfaces having thereon fabric hook material complementary to said loose-pile material of said target board.

3. The game of claim 2 wherein said fabric hook material covers only a portion of the outer surface of said ring.

4. The game of claim 3 wherein said fabric hook material comprises a plurality of circumferentially spaced apart strips of hook material.

5. The game of claim 4 wherein said spaced apart strips of hook material on a first side of said object are longitudinally aligned with gaps between strips of hook material on a second, opposite side of said object.

6. The game of claim 5 wherein said throwing object is further defined as being made of a flexible material.

7. The game of claim 6 wherein said throwing object is further defined as being a composite structure comprising a flexible fabric enclosure forming therewithin an enclosed space, said enclosed space being partially filled with a filling material.

8. The game of claim 7 wherein said filling material is further defined as being a plurality of small weights.

9. The game of claim 8 wherein said throwing object is further defined as having a ring shape.

10. The game of claim 1 wherein each of said target boards is provided near the periphery thereof with a hole adapted to receive a human hand, whereby said hole in each of said target boards may be aligned with said throwing objects adhered between said boards, and carried by a hand inserted through said holes.

11. The game of claim 10 further including an elongated stake and a central coaxial perforation provided through the thickness dimension of said game board adapted to insertably receive said stake.

12. The game of claim 11 wherein said stake has attached to the outer surface thereof a strip of fabric hook material adapted to adhere to said loose pile of said target board, whereby said stake may be sandwiched between and adhered to said pile surfaces of said first and second target boards.

13. A game of skill comprising;

a. a first target board having the shape of a thin flat plate, at least one flat surface thereof which is at least partially covered with a sheet of fabric having a loose pile, b. a second target board substantially identical to said first game board, and c at least one ring-shaped throwing object for board, said throwing object having on two opposite parallel sides thereof strips of fabric hook material having a plurality of hooks protruding therefrom of the proper size and shape to adhere to said loose pile of said target board, said throwing object comprising a toroidal-shaped fabric cover forming an enclosed space therewithin partially filled with a filling material.

14. The game of claim 13 wherein said filling material is further defined as being a plurality of small weights.

15. The game of claim 14 wherein said target board is further defined as having a polygonal outline.

16. The game of claim 14 wherein said target board is further defined as having a circular outline.

17. The game of claim 13 further including at least one elongated, generally cylindrically-shaped stake and a central coaxial perforation provided through the thickness dimension of said game board adapted to insertably receive said stake, said stake having attached to the outer surface thereof a strip of fabric hook material adapted to adhere to said loose pile of said target board, whereby said stake may be sandwiched between and adhered to said pile surfaces of said first and second target boards.

18. The game of claim 17 further including a circumferentially elongated hole provided through the thickness dimension of said target board near the periphery thereof, said hole being adapted to comfortably receive a human hand, thereby facilitating carrying of said game.

19. A throwing object adapted to adhere to loose pile fabric surfaces, said throwing object having a generally circularly symmetric shape, said throwing object having a flexible cover forming an enclosed spaced therewithin containing a filling material, said throwing object having generally parallel opposite faces, each of said opposite faces having thereon a plurality of spaced apart strips of fabric hook material adapted to adhere to loose pile fabric surfaces.

20. The throwing object of claim 19 wherein said strips are interspersed with circumferential gaps.

21. The throwing object of claim 20 wherein said strips on one side of said object overlie said gaps on said opposite side of said object.

22. The throwing object of claim 21 wherein said circularly symmetric shape is further defined as being generally a toroidal shape.

* * * * *